United States Patent [19]

Ueki et al.

[11] 4,209,926

[45] Jul. 1, 1980

[54] DISPLAY DEVICE OF LOUVRE ARRANGEMENT

[75] Inventors: Tetsuro Ueki, Tokyo; Hajime Ogino, Kamakura; Shigeru Yaguchi, Kashiwa, all of Japan

[73] Assignee: Jyoban Jyuki Kensetsu Kabushiki Kaisha, Matsudo, Japan

[21] Appl. No.: 944,355

[22] Filed: Sep. 21, 1978

[30] Foreign Application Priority Data

Jul. 4, 1978 [JP] Japan ..... 53/81327

[51] Int. Cl.[2] ..... G09F 11/00

[52] U.S. Cl. ..... 40/437; 40/486; 40/511; 40/513

[58] Field of Search ..... 40/486, 488, 489, 490, 40/491, 508, 509, 511, 513, 534, 437; 340/755, 756, 757

[56] References Cited

U.S. PATENT DOCUMENTS

| | | | |
|---|---|---|---|
| 1,573,344 | 2/1926 | Jordan | 40/488 |
| 1,609,485 | 12/1926 | Maier | 40/488 |
| 2,117,186 | 5/1938 | MacLaren | 40/488 |
| 3,080,668 | 3/1963 | Reali | 40/491 X |
| 3,283,429 | 11/1966 | Stutz | 40/491 |
| 3,613,277 | 10/1971 | Rose et al. | 40/491 |
| 3,774,330 | 11/1973 | Devanney | 40/491 X |

*Primary Examiner*—John F. Pitrelli
*Assistant Examiner*—G. Lee Skillington
*Attorney, Agent, or Firm*—Fleit & Jacobson

[57] ABSTRACT

A display device of louvre arrangement wherein a display or exhibit is constituted by a group of parallel interleaved strips which are arranged in overlapping relation. The display device has a plurality of such groups. The display device has a driving mechanism having a cam arrangement, driving device, connecting members and a guide device, and cam followers each having an arm at the upper portion. The display device further comprises a frame structure releasably engaged with the connecting members of the driving mechanism, and elongated rigid elements movable together with the strips. Each elongated rigid element has an engaging member for contacting the arm of the cam follower to thereby shift the rigid elements and strips of one group in cooperation with a vertical movement of the cam followers.

6 Claims, 9 Drawing Figures

DISPLAY DEVICE OF LOUVRE ARRANGEMENT

BACKGROUND OF THE INVENTION

The present invention relates to a display device which has, for example, six groups of strips for constituting respective displays which are sequentially or cyclically exposed. More particularly, the present invention relates to improvements of a generally known type of display device in which display or exhibit constituted by a group of parallel interleaved strips arranged in overlapping relation in the manner of louvre-like construction is vanished in an instant as if by magic and another display is sequentially exhibited.

A principle of such a display device will be explained in the first place. A group of parallel interleaved strips, each of which has a width of, for example, 6 cm is overlapped for the width of 4 cm to form a louvre-like construction, whereas the selected edge portion of the strip, namely 2 cm, is exposed, thus forming a predetermined exhibit. In a case that six different displays which may be related to each other or not are to be exhibited sequentially or cyclically, six groups of strips are disposed such that strips of each group are overlapped in the order of series of displays. The strips of each of the groups, which constitute a display, are secured on respective vertically elongated rigid elements through a connecting element.

When all the strips of a first group are in downwardly extended position by lowering the elongated rigid elements of the first group, the extended strips constitute a predetermined display . When the elongated rigid elements of a second group are extended in place of the above-described first group, the display constituted by the strips of the first group suddenly disappear and a new display is exposed and viewed in alternation with the first group.

In such a device, it is desired that the display be substituted or exchanged by other displays and that the substitution or exchange be readily appreciated. An attempt has been made in Japanese Patent Publication No. 50-7439, which corresponds to U.S. Pat. No. 3,613,277, that connectors of the strips are not directly connected to the vertical rigid elements but that the connectors of the strips are secured to resilient supporting elements. In the device described above, all of the resilient supporting elements and strips, both of which have been engaged with the vertical rigid elements, are removed from the apparatus and a new set of resilient supporting elements and strips are substituted therefor.

However, according to the above described display device, the vertical rigid elements should be arranged accurately without extension of any one of the elements. In order to arrange the rigid elements accurately without any extension thereof, a cam device for lifting up and down the vertical rigid elements should be moved from the position to another.

SUMMARY OF THE INVENTION

Accordingly, an object of the present invention is to provide an improved display device which allows a ready replacement of display elements to elements for other displays.

Another object of the present invention is to provide a display device in which the strips are maintained in a parallel posture.

Another object of the present invention is to provide a display device wherein an accurate display or exhibit can be viewed without any distortion.

Another object of the present invention is to provide a displays device wherein a plurality of display may be readily substituted without the involvement of substantial labor or difficulty.

Briefly, a display device of the present invention comprises a display housing, groups of interleaved strips arranged in overlapping relation in the manner of louvre-like construction in the display housing, a driving mechanism, and a plurality of cam followers each having an arm at the upper portion thereof. The driving mechanism has a cam arrangement, driving device, connecting members and guide device. The display device further comprises a frame structure releasably engaged with the connecting members of the driving mechanism, a plurality of elongated rigid elements which are movably supported by the frame structure and a plurality of cross arms for connecting the elongated rigid elements. Each of the elongated rigid elements has an engaging member which contacts the arm of the cam follower to shift the rigid element in cooperation with a vertical movement of the cam follower.

Other objects and features of the present invention will become apparent from the detailed description of preferred embodiment thereof, which will be made with reference to the accompanying drawings.

DETAILED DESCRIPTION OF THE INVENTION

Figure 1:
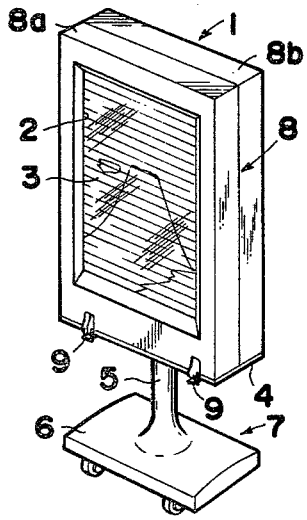
FIG. 1 is a perspective view of a display device in accordance with an embodiment of the present invention.

In the drawings, like parts are designated by the same numerals throughout the various figures.

Figure 2:
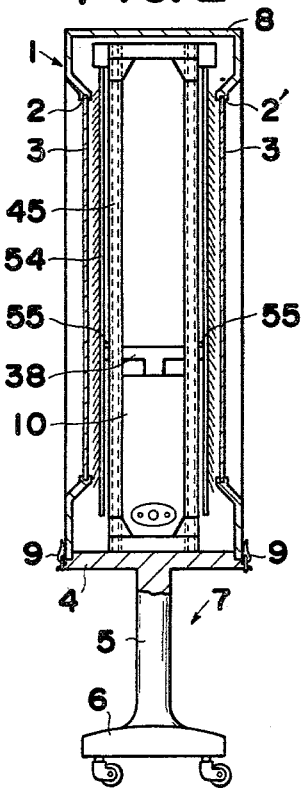
FIG. 2 is a partly sectioned side view of the display device shown in FIG. 1.
Figure 8:
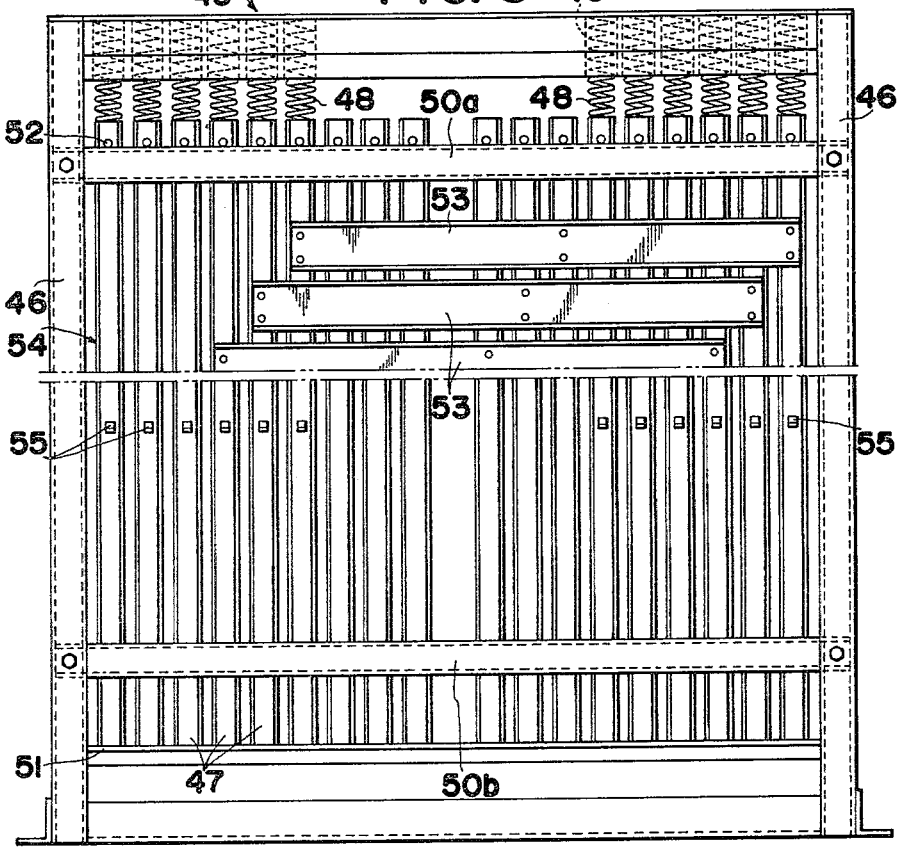
FIG. 8 is a sectioned view of a frame structure and elongated rigid elements.

In FIGS. 1 and 2 which illustrate a display device of the type installed on the floor, the display device has a housing 1 and windows 2, 2' on the both sides thereof. Transparent plates 3 such as glass are fixed to the windows so that displays can be viewed from the both sides. The housing 1 comprises a base plate 4, a leg 5 and a pedestal 6 with casters to form a pedestal section 7. The housing 1 comprises a casing 8 which is box shaped with an open bottom. The casing 8 is installed on the base plate 4 and connected thereto by means of clamps 9. It will be readily understood from the description which will follow hereinafter that the shape of the device may vary widely. In case of a hanging type or tapestry type of the apparatus which is to be installed on the walls, a display of one side will suffice, and the leg and pedestal 6 are not necessary. If the display device, particularly the casing 8, is designed to be large-scaled, it will be appreciated that the casing be designed that same can be divided into two parts, which will permit a ready attachment and detachment thereof. FIG. 8 shows a casing divided into two parts 8*a*, 8*b*.

Figure 3:
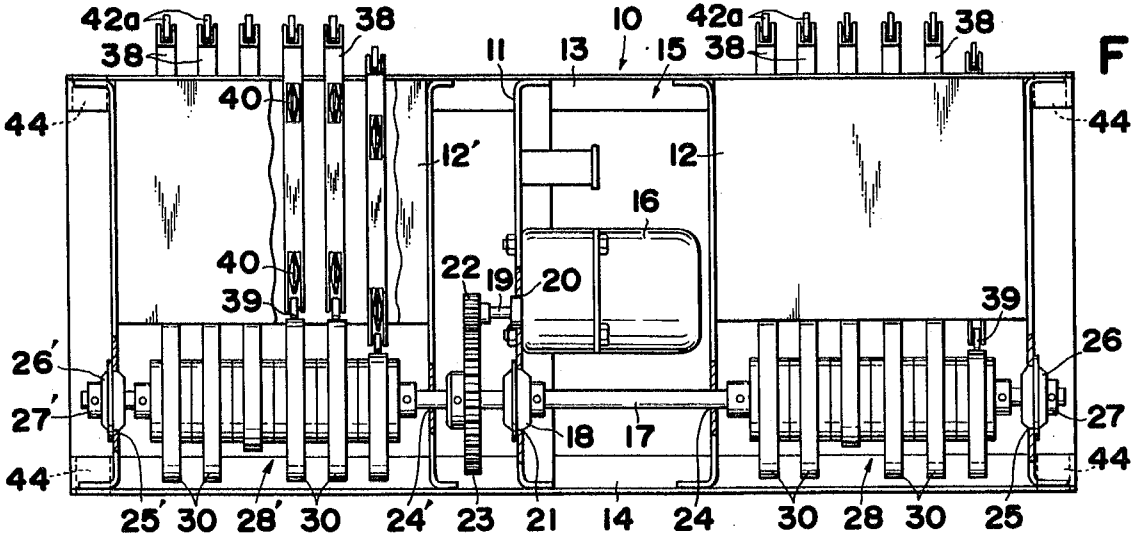
FIG. 3 is a sectioned view of driving mechanism according to the present invention.
Figure 4:
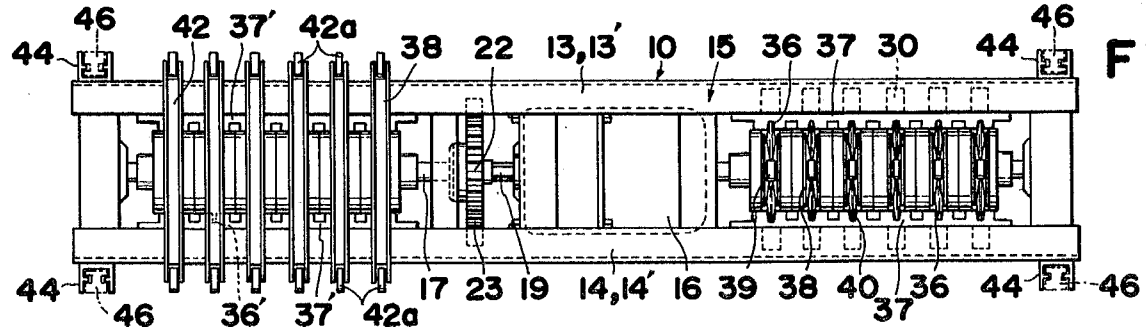
FIG. 4 is a plan view of the driving mechanism shown in FIG. 3.

FIG. 2 shows driving assembly 10, which has, as illustrated in FIGS. 3 and 4, a chassis 11 for attachment of a motor, rectangular cam boxes 12, 12' disposed at the sides of the chassis 11, and a supporting case 15. The chassis 11 is connected at its four corners to the corners of the rectangular cam boxes 12, 12' by means of angle-section members 13, 13', 14, 14'. The chassis 11 has a reduction motor 16 and a bearing 18 for a through-shaft 17. The chassis 11 is provided with a hole 20 for securing an output shaft 19 of the reduction motor 16 and a hole 21 for the bearing 18 of the through-shaft 17. Driving force of the reduction motor 16 is transmitted to the through-shaft 17 by means of a spur gear 23 which is fixed to the through-shaft 17 and a pinion 22 which is fixed to an end of the output shaft 19 of the reduction motor 16. The through-shaft 17 is extended through holes 24, 24' disposed on the inner walls of the rectangular cam boxes 12, 12', and is rotatably secured by bearings 26, 26' which are disposed at the external walls of the rectangular cam boxes 12, 12'. Thrust collars 27, 27' are provided at the ends of the through-shaft 17.

Figure 5:
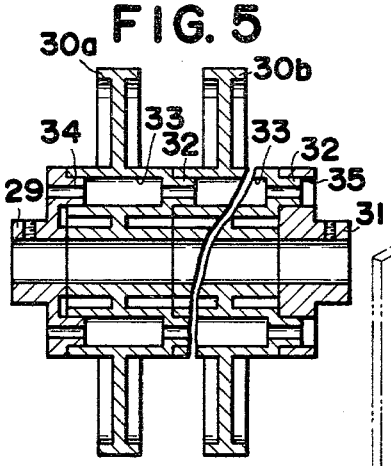
FIG. 5 is a sectioned view of a cam assembly in the display device.
Figure 6:
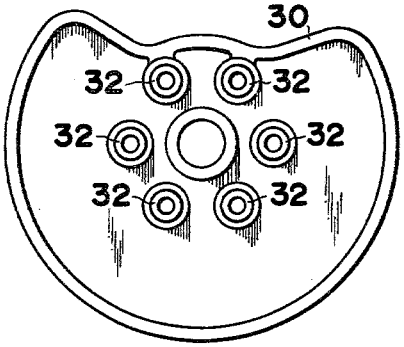
FIG. 6 is a plan view of a cam element.

As described above, the two rectangular cam boxes 12, 12' are disposed within the supporting case 15 of the driving assembly 10. At the through-shaft 17 within the cam boxes 12, 12' are disposed cam assembly 28, 28', each of which comprises end plates 29 and 31 and unit cams 30, as illustrated in FIGS. 5 and 6. The number of the unit cams 30 is identical to, and selected from, the number of displays or exhibits to be viewed. Each of the unit cams 30 has six convex portions 32 on one side thereof and six concave portions 33 on the other side thereof such that the convex portions 32 and concave portions 33 are formed at the constant interval at predetermined circumference of the center of the cam 30. The convex portions 32 have diameter substantially equal to the diameter of the concave portions 33. This concavo-convex structure permits an easy assembly of the unit cams 30. In assembly of the unit cams 30, the cams 30 are assembled such that one cam is tilted or shifted by one concave or convex portion relative to an adjacent cam. After the unit cams 30 are assembled in a shifted fashion as described above, the end plate 29 which has a protrusion 34 is attached to the left end cam 30*a* whereas the end plate 31 which has a hole 35 is attached to the right end cam 30*b* such that the concave portion 32 of the right end cam 30*b* is secured by the hole 35 of the end plate 31. Then, the cams 30 are fixed to the through-shaft 17 by means of a suitable elements such as set bolts or equivalent. Within the cam boxes 12, 12', there are disposed in an opposed relation planar elements 37, 37' which have vertical guide grooves 36, 36', respectively.

Figure 7:
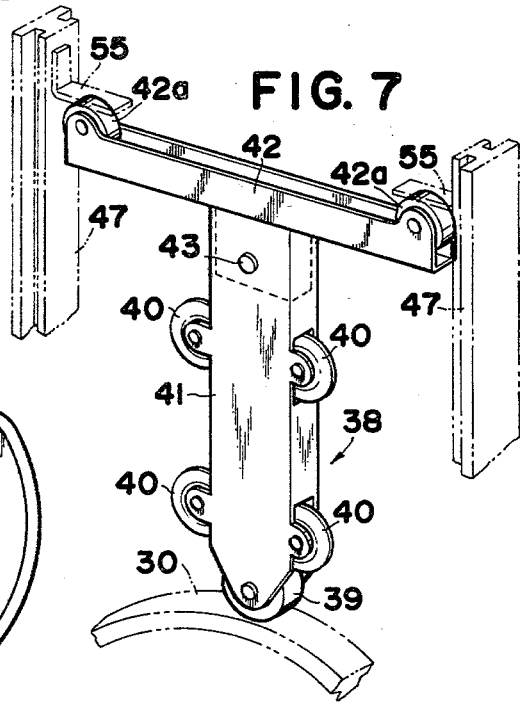
FIG. 7 is a perspective view of a cam follower.

Between the adjacent vertical guide grooves 36, 36', there is installed a cam follower 38, which is shown in FIG. 7. The cam follower 38 has a flat cylindrical body 41 and an arm 42 which is releasably connected to the top of the cylindrical body by means of a pin 43. The arm has rolls 42*a* at the ends thereof and is extended laterally in the opposite directions to form a T-shaped structure. The cam follower 41 has, at its bottom, a cam roller 39 which contacts the cam 30, and guide rollers 40 at the both sides of the cylindrical body 41. It may be readily understood that the cam follower 38 may be formed in an inverted L-shaped structure wherein the arm 42 is extended in one direction. It may be readily understood that the rollers 40 disposed at the sides of the cylindrical body 41 permit a smooth vertical movement of the cam follower 38 even when an unbalanced weight is added to the cam follower 38. If possible, however, these rollers 40 can be removed, and the cylindrical body is slidably mounted directly within the guide groove 36.

Referring again to FIGS. 3 and 4, there are provided eight connecting members 44 at the upper and lower corners of the supporting case 15, to which four legs 46 of a frame structure 45 are engaged when the legs 46 are slided downward from top of the apparatus. Namely, eight ends of the four legs 46 are releasably engaged with the connecting member 44.

In FIG. 8 which shows a vertically sectioned view of the frame structure 45, vertical rigid elements of six groups, each group being formed with three rigid elements, are supported by the frame structure 45 such that groups of the vertical rigid elements may be shifted in the vertical direction. The frame structure has at its top end spring cases 49 in which compressive springs 48 are disposed for the purpose of pressing resiliently the top end of each of the vertical rigid elements 47, and guide members 50*a* and 50*b* at the upper and lower portions for guiding accurately the vertical movement of the vertical rigid elements 47. At the portion lower than the guide member 50*b*, a receiving member 51 is disposed to receive the lower end of the vertical rigid elements 47 so that the vertical rigid elements 47 accurately stand side by side in a parallel relation. These elements 49, 50, 51 are disposed at the front and reverse side of the frame structure 45. The receiving member 51 which receives the vertical rigid elements 47 prevents the frame structure from being accidentally lifted upward, and the vertical elements from being dropped off during transportation of the apparatus. In place of the receiving member 51, pins 52 may be provided at the reverse side of the vertical rigid elements so that the movement of the vertical rigid elements may be limited by means of the contact between the pins 52 and the guide member 50*a*. Further, when tension springs (not shown) are used in place of the compression springs 48, the spring cases 49 will not be needed (refer to FIG. 9), and the compression springs 48 may be connected at one end to the lowest end of the vertical rigid elements 47, and to the bottom of the frame structure at the other end thereof.

The vertical rigid elements 47 in each group are connected together by means of respective cross arms 53 to form an element group 54, shown in FIG. 8.

In FIG. 8 which shows eighteen vertical rigid elements 47, engaging members 55 are disposed at the rear side of the vertical rigid elements of the right end to the sixth, and the rigid elements of the left end to the sixth in the drawing, whereas the vertical rigid elements in the middle portion have no such engaging member. When the legs 46 of the frame structure 45 are engaged with the connecting member 44, the engaging members 55 are contacted with rolls 42*a* of the arm 42 of the cam followers 38. Thus, the element groups 54, each of which is made up of three vertical rigid elements and a single cross arm 53, are moved in the vertical direction in a smooth and balanced manner. Namely, cam assembly 28, 28' of the left hand side and right hand side are rotated so that respective unit cam 30 and the cam follower 38 are driven to move two of the vertical rigid elements 47 in the vertical direction. Thus, the predetermined element group 54 is moved in the vertical direction in a smooth and balanced manner. This structure is effective for preventing the strips, which form a display and will be described hereinafter, from being unbalanced. If the strips are unbalanced, the display or exhibit constituted by the strips will become distorted.

Figure 9:
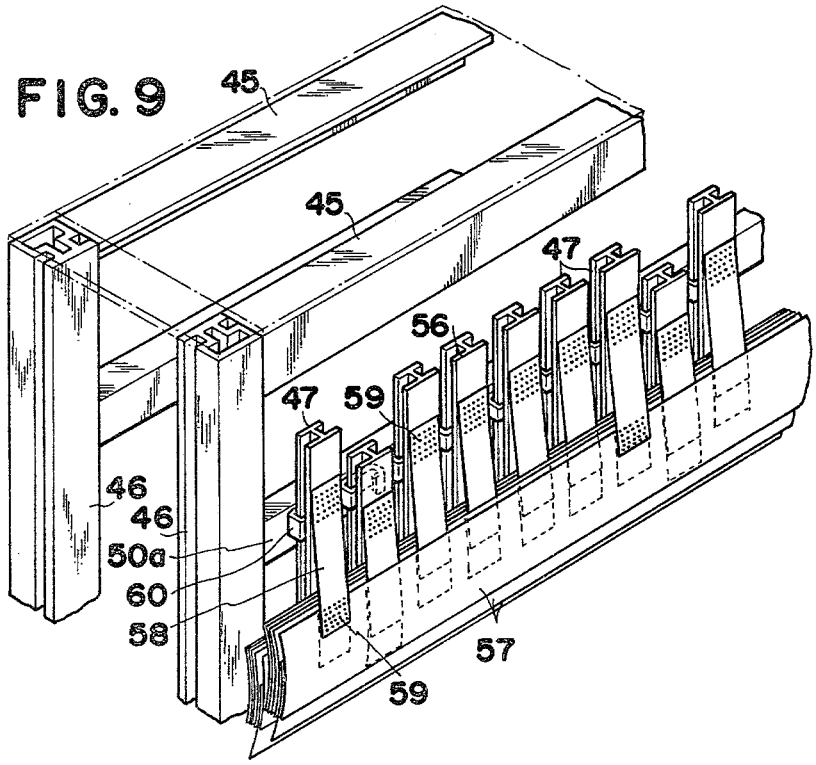
FIG. 9 is a perspective view of strips and the elongated rigid elements.

The vertical rigid elements and strips are shown in FIG. 9. The vertical rigid elements 47 have an H-shape in cross section as illustrated, and a synthetic resin plate 56 on the entire front surface thereof. A connecting strip 58 made of a suitable synthetic resins tape is connected at one end thereof to the synthetic resin plate 56 of the vertical rigid elements and to the strip 57 at the other end thereof, by an ultrasonic welding method. In the drawing, reference numeral 59 represents connecting spots between the resin tape 58 and the strip 57.

As shown in FIG. 9, the strips, which construct a display when all the strips of a group are extended position, are slightly curved so that the strips of one group are overlapping relation in a close contact manner. When the number of the strips which are in overlapping relation are increased, the extended, selected edge portions of the strips 57 are spaced apart from adjacent selected edge portions of the strips if the strips are not curved but flat. This is quite a serious shortcoming in the display device of louvre-like construction. Namely, a vertical straight line, for example, constituted by the edge portions of the selected strips is viewed in a zig-zag manner particularly when viewed from the perspective position of the display apparatus. By contrast, the curved strips in the present invention force the edge portions of the selected strips to be closely contacted with each other to constitute a display which can be viewed without any distortion.

The vertical rigid elements are vertically slidably held by holders 60 which are connected to the guide member 50*a*. The holders 60 are designed to be hook shaped in the illustrated embodiment of the invention, but it will be readily understood that the holders are not limited to such a shape but may be constructed such that rollers (not shown) are provided for guiding the vertical movement of the vertical rigid elements 47.

In FIG. 9, a first strip group and a second strip group of different six displays are illustrated and six vertical rigid elements of the aforementioned first strip group are shown as well as three vertical rigid elements of the aforementioned second strip group, for the purpose of simplification. In the drawing, the second vertical rigid elements from the left extremity in each strip group of the six displays are lowered to expose the strips of a group of different six displays. Thus, the extended, exposed strips constitute a predetermined display or exhibit.

A fluorescent paint is advantageously employed in the printing of the strips, and the fluorescent paint is stimulated by long-wave ultraviolet rays from a black light fluorescence discharge tube so as to set the display off to advantage and permit an advancement of displaying effect. Such a fluorescence discharge tube is advantageously disposed outside the housing of the display apparatus so that the strips of the display are stimulated from the outside of the apparatus.

According to the display apparatus of the present invention in which six kinds of views at one side, and twelve kinds of views at the both sides, of the apparatus can be readily displayed, the displacement of the display elements can be readily carried out by lifting the frame structure 45 upward to the height of the supporting case 15 of the driving assembly 10. Remainders after the frame structure 45 is displaced from the apparatus are the driving assembly 10 and the cam follower 38. A new frame structure wherein new rigid elements and strips are involved may be inserted from above to the driving assembly 10 so that the connecting members 44 of the driving assembly 10 are engaged with the legs 46 of the frame structure 45. In this engagement, the engaging members 55 of the vertical rigid elements 47 are contacted with the end portions of the arm 42 of the cam follower 38. Accordingly, the displacement of the frame structure can be readily employed without involvement of touching the driving assembly 10 and the cam follower 38.

Though the present invention has been described with reference to preferred embodiment thereof, many modifications and alterations may be made within the spirit of the present invention.

What is claimed is:

1. A display device wherein a plurality of groups of strips are arranged in overlapping relation and the groups are moved through one another to expose one group at a time for viewing comprising:

(a) a display housing;

(b) groups of interleaved strips arranged in overlapping relation in the manner of louvre-like construction in said display housing;

(c) a driving mechanism disposed in said display housing; said driving mechanism comprising at least a pair of cam arrangements, driving means for driving said pair of cam arrangements, and vertical guide grooves positioned above said pair of cam arrangements, said cam arrangements having a cam element for each group of said interleaved strips, a first end plate and a second end plate, said cam elements each having concave portions on one side thereof at constant intervals and convex portions on the other side at the constant intervals, said first end plates having protrusions and said second end plates having holes, said cam elements being associated with each other by means of concavo-convex engagement and secured by said first and second end plates;

(d) a plurality of cam followers each having an arm at the upper portion thereof; said cam followers each being vertically slidable along said guide grooves of the driving mechanism;

(e) a frame structure releasably engaged with the driving mechanism;

(f) a plurality of elongated rigid elements which are movably supported by said frame structure; said elongated rigid elements each having an engaging member which contacts said arm of the cam follower to shift said rigid element in cooperation with a vertical movement of said cam follower;

(g) a plurality of cross arms for connecting said elongated rigid elements in a pair-fashion; and (h) a plurality of tabs for suspending the strips from the elongated rigid elements.

2. The display device in accordance with claim 1, in which said cam arrangement is provided in an opposed relation relative to said driving device.

3. The display device in accordance with claim 1, in which each of said cam followers has a cylindrical body having rollers in an opposed relation and a roller at the lower extremity thereof, said arm being extended in opposite direction to form a T-shaped structure, said arm having rollers at the free extremity.

4. The display device in accordance with claim 1, in which said frame structure has a plurality of springs to resiliently force the rigid elements downward, a guide member for an accurate vertical movement of said vertical rigid elements, and a receiving member at the lower end portion of the frame structure for receiving the vertical rigid elements.

5. The display device in accordance with claim 1, in which each of the elongated rigid elements has a synthetic resin tape adhered thereon, said tabs for strip suspension being connected at one end to said synthetic resin tape.

6. The display device in accordance with claim 1, in which said strips are slightly curved, whereby the strip exposed in one group is closely contacted with adjacent strip of the same group.

* * * * *